US005339129A

United States Patent [19]

Hehn et al.

[11] Patent Number: 5,339,129

[45] Date of Patent: Aug. 16, 1994

[54] DEVICE FOR WIPING LIQUIDS OFF RUNNING WEBS OF PHOTOGRAPHIC MATERIAL

[75] Inventors: Wilfried Hehn, Munich; Viktor Osegowitsch, Taufkirchen, both of Fed. Rep. of Germany

[73] Assignee: Agfa-Gevaert Aktiengesellschaft, Leverkusen, Fed. Rep. of Germany

[21] Appl. No.: 11,676

[22] Filed: Feb. 1, 1993

[30] Foreign Application Priority Data

Feb. 14, 1992 [DE] Fed. Rep. of Germany ..... 4204440

[51] Int. Cl.[5] ..... G03D 3/08; G03D 5/00

[52] U.S. Cl. ..... 354/318; 354/321

[58] Field of Search ..... 354/316–324; 355/27, 28, 100, 106; 492/18, 20, 24, 25; 118/112, 114, 123, 124, 126, 410, 413, 414, 419, 662, 647, 637

[56] References Cited

U.S. PATENT DOCUMENTS 3,874,283 4/1975 Igarashi ..... 100/121
3,923,520 12/1975 Burke, Jr. ..... 354/317 X
4,773,580 9/1988 Schweiger ..... 226/92
4,837,593 6/1989 Hehn ..... 354/322
5,134,958 8/1992 Zimmer ..... 118/119

FOREIGN PATENT DOCUMENTS 2048902 4/1972 Fed. Rep. of Germany .
2545487 4/1977 Fed. Rep. of Germany .
4032838 5/1991 Fed. Rep. of Germany .

*Primary Examiner*—D. Rutledge
*Attorney, Agent, or Firm*—Darby & Darby

[57] ABSTRACT

That side of a running web of photographic material issuing from a bath of a developing machine which is not coated with photosensitive material is relieved of entrained liquid by a rigid stationary wiping member which constitutes or forms part of a cylinder extending transversely of the path of movement of and contacting the uncoated side of the running web. The coated side can be wiped by a lip which engages the web opposite the area of contact between the uncoated side and the wiping member.

4 Claims, 1 Drawing Sheet

DEVICE FOR WIPING LIQUIDS OFF RUNNING WEBS OF PHOTOGRAPHIC MATERIAL

BACKGROUND OF THE INVENTION

The invention relates to improvements in devices for removing liquids from running webs of photographic material. More particularly, the invention relates to improvements in devices which can wipe off liquid, e.g., a layer of liquid, at least from that side of a running web of photographic film or the like which is not coated with photosensitive material.

Published German patent application Ser. No. 20 48 902 discloses a wiping device which can be used in, or in combination with, a developing machine for exposed webs of photographic material. The wiping device includes a flexible rubber lip which urges the running web against the peripheral surface of a rotating roller. The lip contacts and wipes liquid off that side of the running web which is coated with photosensitive material. The other (uncoated) side of the web is supposed to be relieved of liquid as a result of urging the web against the rotating roll. In other words, successive increments of the uncoated side of the running web are pushed against successive increments of the peripheral surface of the rotating roll, i.e., the liquid is supposed to be squeezed off the uncoated side of the web. It has been found that the liquid removing action of the rotating roll at the uncoated side of the running web is unsatisfactory, i.e., excessive quantities of liquid are permitted to be entrained from a first bath (e.g., a developing bath) into a next-following bath (e.g., a fixing bath) of the developing machine.

Attempts to improve the liquid removing action at the uncoated side of a web of photographic material include the provision of a second elastically deformable lip which replaces the rotatable roll. The second lip cooperates with the lip at the coated side of the running web to simultaneously relieve both sides of the running web of moisture which is entrained as the web is caused to advance through and beyond a liquid bath in a developing machine. As a rule, the coated side of a web of photographic material will accept and entrain more liquid than the uncoated side; this is due to the fact that the photosensitive emulsion swells during advancement through a liquid bath and is thus capable of accepting and entraining more liquid than the uncoated side. Therefore, the rear side of the running web is caused to assume a concave shape which results in the establishment of very pronounced pressure between one of the lips and the marginal portions of the web. The pressure is so pronounced that the one lip is notched and/or otherwise deformed and damaged so that it must be replaced after a short period of use. This necessitates a lengthy stoppage of the developing machine with attendant losses in output.

OBJECTS OF THE INVENTION

An object of the invention is to provide a novel and improved device wherein the useful life of the web contacting wiping member or members is longer than in the device of the aforediscussed published German patent application.

Another object of the invention is to provide a device which can remove a high percentage of liquid from the uncoated side of a running web of exposed photographic film or other photographic material.

A further object of the invention is to provide a simple and inexpensive member which can be used to wipe liquid off the uncoated side of a running web of photographic material.

An additional object of the invention is to provide a novel and improved device which can simultaneously remove liquid from both sides of a running web of photographic material.

Still another object of the invention is to provide a device which can be installed in existing developing and other machines to remove surplus liquid from one or both sides of a running web of photographic material.

A further object of the invention is to provide a novel and improved combination of wiping members for use in the above outlined device.

SUMMARY OF THE INVENTION

The invention is embodied in a device for removing liquid from at least one side of a running web of photographic material which is advanced in a predetermined direction along a predetermined elongated path (e.g., in a developing machine for exposed photographic customer films or in a machine for copying the images of exposed and developed customer films onto webs of photographic paper). The improved device comprises a rigid stationary wiping member which is adjacent one side of the path and has a convex portion in contact with the one side of the running web in the path.

The convex portion extends transversely of the path. The wiping member can include or constitute a cylinder or a portion of a cylinder extending transversely of the path and being held against rotation, i.e., the one side of the web rubs against and moves relative to the convex portion of the wiping member.

The convex portion of the wiping member can consist of a hard nonelastic material, e.g., a ceramic material.

The radius of curvature of the convex portion of the wiping member can be in the range of 2.5 to 10 mm, i.e., the diameter of a cylindrical wiping member can be in the range of 5 to 20 mm.

The wiping member can further comprise a sloping portion in the form of a ramp which is located upstream of the convex portion and slopes in the direction of advancement of the web toward the predetermined path. Such ramp can be used with advantage in developing machines wherein the leader of a web of photographic material is clamped to the trailing end of a band which entrains the web through the developing machine. The ramp prevents the clamps for the leaders of the webs from being caught by the wiping member.

The device further comprises means (e.g., suitably positioned guide rolls (such as idler rolls) for maintaining the one side of the running web in contact with the convex portion of the wiping member, preferably along an arc of 10°–20°.

Still further, the device can comprise a web engaging wiping lip at a second side of the path opposite the one side of such path. The convex portion of the wiping member and the lip can define a nip for the running web. The lip can be positioned to contact a second side of the running web opposite a part of the convex portion of the wiping member. This part of the convex portion is preferably located within an angle of approximately 15° extending to both sides of a plane which includes the center of curvature of the convex portion and extends transversely of the predetermined path. Such angle can include a smaller portion (e.g., approximately 5°) upstream and a larger portion (e.g., approximately 10°) downstream of the aforementioned plane.

The convex portion of the stationary wiping member preferably contacts the uncoated side of the web, i.e., that side of the web which carries a layer of photosensitive material can be contacted by the preferably elastic lip.

The novel features which are considered as characteristic of the invention are set forth in particular in the appended claims. The improved wiping device itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
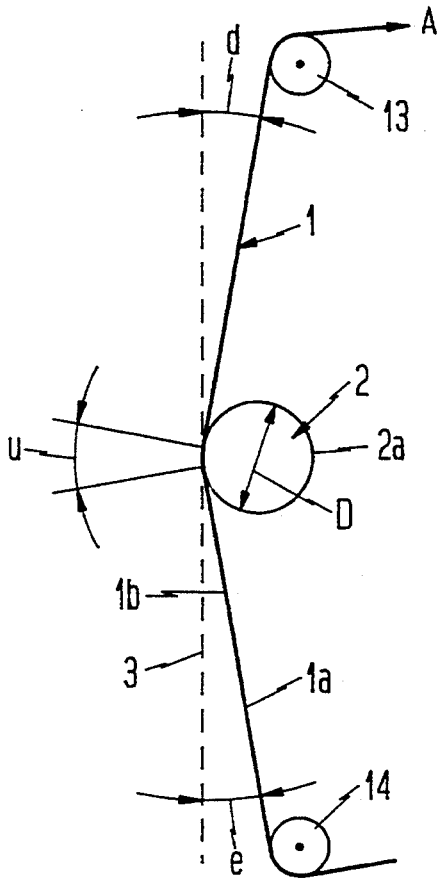
FIG. 1 is a schematic end elevational view of a device which embodies one form of the invention and wherein the single wiping member is a cylinder which contacts the uncoated side of a running web of photographic material.

Referring to FIG. 1, there is shown a wiping device which comprises a stationary rigid cylindrical wiping member 2 and two idler rolls 13, 14 which serve to maintain one side la of a running web 1 of photographic material in contact with a (convex) portion of the peripheral surface 2*a* of the wiping member 2. The web 1 is advanced in the direction of arrow A in a manner not forming part of the present invention (e.g., in a manner customary in developing machines for exposed customer films which are spliced together end-to-end to form elongated webs which are transported through successive baths of and thereupon through one or more drying chambers in a developing machine). The idler rolls 13, 14 cooperate with the wiping member 2 to maintain the web 1 in a predetermined path one side of which is adjacent the peripheral surface 2*a* of the member 2 and the other side of which faces away from the surface 2*a*. The reference character 1*b* denotes that side of the running web 1 which is coated with a layer of photosensitive material. The path for the web 1 departs from a straight line 3 which is exactly tangential to the peripheral surface 2*a* of the wiping member 2. The line 3 is parallel to a line which is tangential to the rolls 13, 14 and which would properly denote the path for the web 1 in the absence of the wiping member 2.

It has been found that a highly satisfactory wiping or demoisturizing action can be achieved if the angle d between the line 3 and the adjacent portion of the web 1 downstream of the wiping member 2 is between 5° and 10°. The same preferably applies for the angle e between the line 3 and the web portion upstream of the member 2 (as viewed in the direction of arrow A). Such positioning of the rolls 13, 14 relative to the wiping member 2 causes the side 1*a* of the running web 1 to contact the peripheral surface 2*a* along an arc u of between approximately 10° and 20°. Each of the illustrated angles d and e equals or approximates 10°. If one of the angles d and e is to exceed the other of these angles, the positions of the rolls 13 and 14 relative to the member 2 will be changed accordingly; for example, the member 2 will be moved away from a position substantially or exactly midway between the rolls 13 and 14. It has been found that the wiping action of the member 2 is optimal, or at least highly satisfactory, if the angle or arc u is not appreciably less than 10° and not appreciably more than 20°, i.e., if the sum of the angles d and e is between approximately 10° and 20°.

The magnitude of the force with which the running web 1 is urged against the peripheral surface 2*a* of the wiping member 2 increases in response to an increase of the arc u. Furthermore, the magnitude of such force can be increased (by increasing the area of contact between the side 1*a* of the running web 1 and the peripheral surface 2*a*) if the illustrated wiping member 2 is replaced with a cylindrical member having a larger diameter D. The increase of the area of contact between the side 1*a* and the surface 2*a* is substantially proportional to the increase of the diameter D. The above factors can be taken into consideration by ascertaining or selecting the surface pressure between the running web 1 and the wiping member 2. Such surface pressure is or can be the same by selecting a relatively small diameter D and a relatively small arc u or by selecting a larger diameter D and a larger arc u. The relationship between the diameter D and the arc u can be expressed, approximately, with the following equation:

$$D = \frac{\sin \frac{u}{2}}{180 - u}.$$

Thus, by selecting a desired arc u, one can rapidly and reasonably accurately ascertain the corresponding diameter D by resorting to the above equation.

Figure 2:
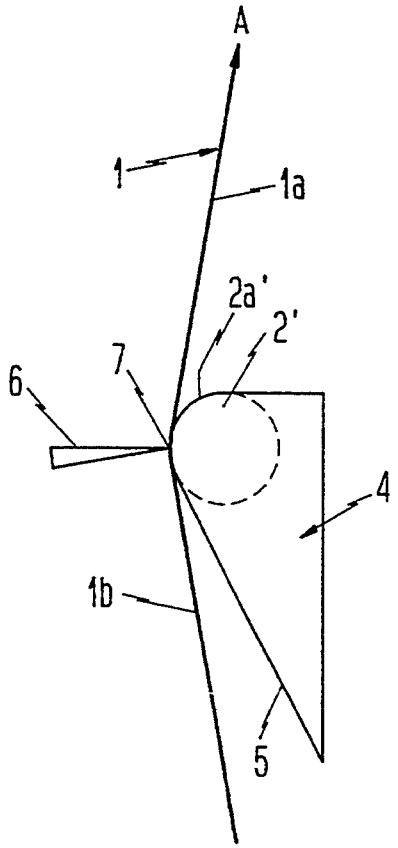
FIG. 2 is a similar schematic end elevational view of a modified device with two wiping members one of which constitutes a lip engaging the coated side of a running web of photographic material.
Figure 3:
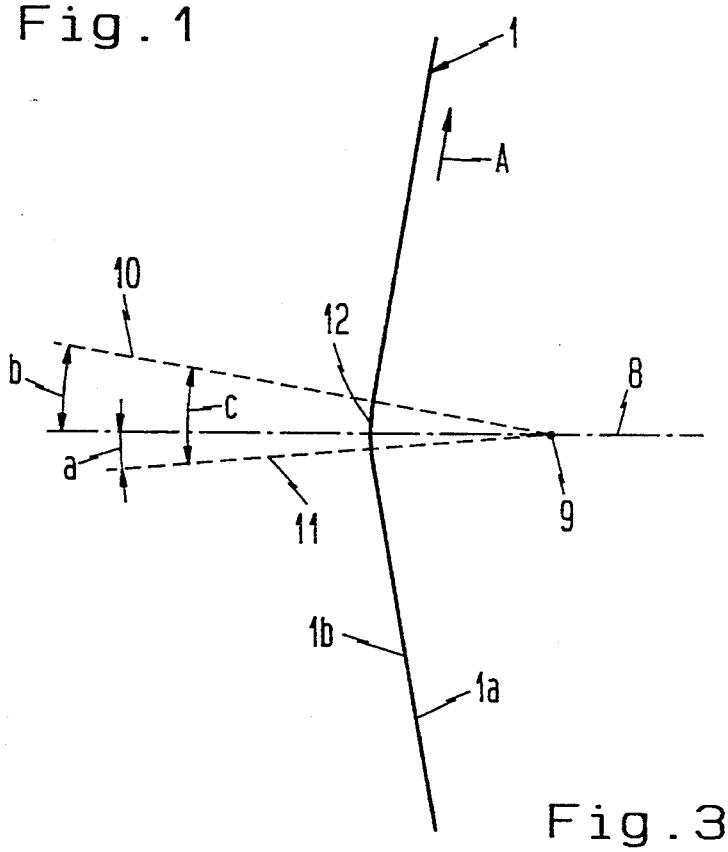
FIG. 3 is a larger-scale view of a detail in the device of FIG. 2.

FIGS. 2 and 3 illustrate certain parts of a second liquid removing device which comprises a stationary rigid first wiping member 4 replacing the member 2 of FIG. 1 and a second wiping member in the form of an elastic lip 6 of the type known from heretofore used liquid removing devices. The wiping member 4 includes a portion 2' which has a surface 2*a'* including a convex portion in contact with the uncoated side la of the running web 1. The lip 6 serves to wipe liquid off the coated side 1*b* of the web 1 and its tip defines with the portion 2' of the wiping member 4 a nip 7 for successive increments of the running web 1.

The wiping member 4 resembles or constitutes a wedge and includes a ramp 5 which slopes toward the path for the web 1 and toward the area of contact between the convex surface 2*a'* and the side 1*a* of the web. It will be noted that the ramp 5 is located upstream of the convex surface 2*a'*, as seen in the direction of arrow A, i.e., in the direction of advancement of the web 1 along its path.

The wedge-like wiping member 4 can be used with advantage in developing machines wherein the leader of the web 1 is separably affixed to the trailing end of an entraining band (not shown) by one or more clamps. The ramp 5 reduces or eliminates the likelihood of interception of clamps by the member 4. Reference may be had to commonly owned U.S. Pat. No. 4,773,580 granted Sep. 27, 1988 to Ernst Schwiger for "Device for transmitting motion to webs of photographic material in developing machines and the like" which describes and shows means for clamping the leader of a web to the trailing end of an entraining band in a developing machine. A developing machine in which the present invention can be put to use is disclosed, for example, in commonly owned U.S. Pat. No. 4,837,593 granted Jun. 6, 1989 to Wilfried Hehn for "Apparatus for wet treatment of photosensitive material". The disclosures of these patents are incorporated herein by reference.

It is advisable to position the tip of the lip 6 (i.e., the nip 7) opposite that portion of the side 1*a* which is contacted by the convex peripheral surface 2*a'* of the wiping member 4. It is even more desirable and advantageous to locate the nip 7 within a certain part of the side 1*b* opposite the area of contact between the side 1*a* and the wiping member 4. As can be seen in FIG. 3, such area preferably extends to both sides of a plane 8 which includes the center of curvature 9 of the convex surface 2*a'* and extends transversely of and across the path for the web 1. The angle c can be in the range of 15° and can include a smaller portion a (e.g., up to 5°) upstream of the plane 8 and a larger portion b (e.g., up to 10°) downstream of the plane 8 (as seen in the direction of arrow A). It has been found that the just outlined selection of the locus of the nip 7 relative to the plane 8 ensures highly satisfactory wiping of liquid off the sides 1*a* and 1*b* of the running web 1. The area 12 of preferred contact between the side 1*b* and the tip of the lip 6 is flanked by planes 10 and 11 which intersect each other at the center of curvature 9 and make an angle (c) of approximately 15°.

A presently preferred material for the wiping member 2 and the wiping member 4 (or at least for the portion 2' of the wiping member 4) is a suitable ceramic material, i.e., a rigid nonelastic material which can stand the corrosive action of liquid at the side 1*a* of the running web 1.

It has been found that the liquid removing action at the side 1*a* of the web 1 can be improved by between 20 and 40 percent with the simple expedient of replacing a rotary wiping member with the stationary wiping member 2 or 4. The fact that the wiping member 2 or 4 is made of a rigid nonelastic material is of no consequence because this member contacts the uncoated side 1*a* of the web 1. Ceramic materials are preferred at this time because they can stand the corrosive effect of the entrained liquid as well as the mechanical action of the rather sharp edges of the running web 1. Moreover, such ceramic wiping members can stand the mechanical action of the aforediscussed entraining bands and of the clamps or clips which are used to releasably couple the leaders of webs 1 to such bands. Certain other materials can be used with equal or similar advantage to make the wiping member 2 or 4. For example, such wiping members can contain one or more ceramic materials together with certain other material or materials. It is also possible to make the wiping member 2 or 4 of a sintered metallic material or of certain plastic materials, particularly highly wear-resistant plastic materials.

The diameter D of the cylindrical wiping member 2 or the diameter of the cylindrical portion 2' of the wedge-like member 4 can be in the range of 10–20 mm, i.e., the radius of curvature of the surface 2*a* or 2*a'*is or can be in the range of 5–10 mm.

The lip 6 exhibits the advantage that it can remove liquid from the coated side 1*b* of a running web 1 simultaneously with wiping of liquid off the side 1*a*. In addition, the lip 6 bears against the side 1*b* with a certain force, i.e., the side 1*a* is urged against the convex surface 2*a* or 2*a'* partly due to the bias of the lip 6 to thus enhance the liquid removing action of the wiping member 2 or 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Device for removing liquid from both sides of a running web of photographic material which is advanced along a predetermined path, comprising a rigid stationary wiping member adjacent one side of said path and having a convex portion in contact with the one side of the running web in said path; and a web engaging wiping lip at a second side of said path opposite said one side of said path.

2. The device of claim 1, wherein said convex portion and said lip define a nip for the running web in said path.

3. The device of claim 1 for removing liquid from both sides of a running web which is advanced along said path in a predetermined direction, wherein said convex portion has a center of curvature and said lip is positioned to contact a second side of the running web opposite a part of said convex portion located within an angle of approximately 15° extending to both sides of a plane including said center of curvature and extending transversely of said path.

4. The device of claim 3, wherein said angle includes a smaller portion upstream and a larger portion downstream of said plane.

* * * * *